United States Patent [19]

Sollinger et al.

[11] Patent Number: 5,045,153

[45] Date of Patent: Sep. 3, 1991

[54] DOUBLE SCREEN FORMER WITH FLEXIBLE LATHS SPACED GREATER THAN OPPOSITE RIGID LATHS

[75] Inventors: Hans-Peter Sollinger; Rudolf Bück; Dieter Egelhof; Hubert Polifke, all of Heidenheim, Fed. Rep. of Germany

[73] Assignee: J. M. Voith GmbH, Heidenheim, Fed. Rep. of Germany

[21] Appl. No.: 654,784

[22] Filed: Feb. 11, 1991

[30] Foreign Application Priority Data

Feb. 21, 1990 [DE] Fed. Rep. of Germany ..... 4005420

[51] Int. Cl.[5] ..... D21F 9/02; D21F 1/36

[52] U.S. Cl. ..... 162/301; 162/300; 162/352

[58] Field of Search ..... 162/300, 301, 348, 352

[56] References Cited

FOREIGN PATENT DOCUMENTS

| | | | |
|---|---|---|---|
| 3138133 | 3/1983 | Fed. Rep. of Germany | 162/301 |
| 3153305 | 10/1986 | Fed. Rep. of Germany | 162/301 |
| 89/02499 | 3/1989 | PCT Int'l Appl. | 162/301 |

*Primary Examiner*—Karen M. Hastings

*Attorney, Agent, or Firm*—Jeffers, Hoffman & Niewyk

[57] ABSTRACT

A double screen former for the manufacture of a paper web has two continuous screens forming together a double screen zone. The one screen runs in the double screen zone across rigid laths that are arranged on the dewatering box at a mutual spacing. Additionally, the other screen runs in the double screen zone across several laths which are supported by means of flexible elements and can be forced on the screen at a selective force. The space between the flexibly supported laths is at least approximately twice as large as the space between the rigid laths.

6 Claims, 1 Drawing Sheet

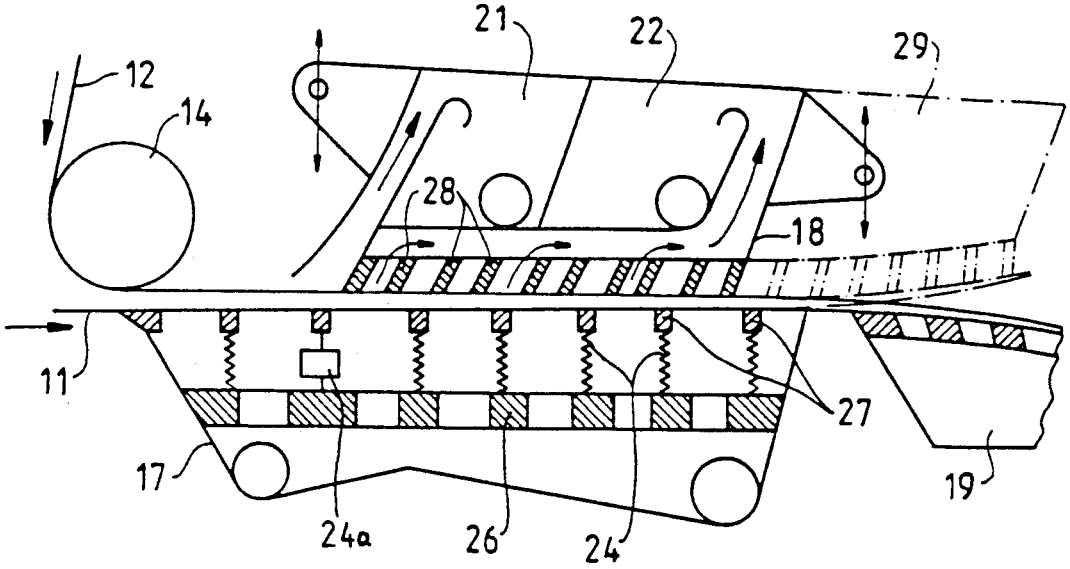
21
22
29
12
14
28
18
11
27
17
19
24a
26
24

DOUBLE SCREEN FORMER WITH FLEXIBLE LATHS SPACED GREATER THAN OPPOSITE RIGID LATHS

BACKGROUND OF THE INVENTION

The invention concerns a double screen former for the manufacture of a fiber material web, specifically a paper web, from a fiber material suspension.

The invention is based on the object of the yet unpublished German patent application P 3927597.3. Each of the flexibly supported laths is arranged there opposite a gap between two rigid laths. There are approximately as many rigid laths provided as there are flexible ones, so that a zigzag arrangement of the laths comes about. The spacing between the laths is relatively large, namely, about five times as great as the thickness of the laths. What is to be accomplished with these relatively large spaces (compared to the object of DE OS 3823966) is an easier removal of the water proceeding through the wire meshes. This applies, for instance with a horizontal extension of the screen, primarily to the laths contained in the bottom screen loop. In the case of relatively small spaces between the laths, clogging had occasionally occurred there, for instance through deposition of slime substances between the laths.

On the other hand, one of the advantages of the prior double screen former is that fiber material webs with a relatively good formation can be formed; i.e., a very beautiful, uniform fiber distribution is accomplished in the finished fiber material web, for instance in the paper web.

Difficulties have occurred, however, in that due to the changeover to larger spaces between the laths, the results regarding the formation are no longer fully satisfactory.

Therefore, the problem underlying the invention is to advance the double screen former so that both requirements will be met, namely on the one hand a maximally good formation of the formed fiber material web, and on the other hand the elimination of the risk of depositions between the laths.

SUMMARY OF THE INVENTION

This problem is solved through the features of the present invention. Surprisingly, it has been found that through the use of an unequal number of laths on the two screens, specifically through unequal spaces between the laths, not only the desired good formation can be achieved but at the same time also sufficiently large spaces will exist between the laths of the one screen to assure at any time the drainage of the screen water. In the case of a screen that travels horizontally, the laths contained in the bottom screen will preferably be so arranged that a larger mutual spacing will exist. Surprisingly, tests have established that for achieving a good formation in the finished fiber material web it is sufficient to arrange only the laths of one of the two screens at a relatively slight mutual spacing. In other words, it is sufficient to introduce only from one side and through a relatively large number of laths several times successively pressure surges into the partly still liquid fiber material layer.

The invention, in one form thereof, comprises a double screen former for the manufacture of a fiber material web, specifically a paper web, from a fiber material suspension. Two continuous screens form together a double screen zone. One of the screens run in the double screen zone across rigid laths that are arranged on the dewatering box at a mutual spacing. The other screen runs in the double screen zone across several laths which are supported by flexible elements such as springs, pneumatic pressure cushions or the like, and are pushed on the screen at a selective force. The spacing between the flexibly supported laths is at least approximately twice as large as the spacing between the rigid laths.

In accordance with another embodiment of the present invention, at least part of the flexibly supported laths are always arranged opposite the gaps between two rigid laths.

In accordance with yet another embodiment of the present invention, the spacing between two adjacent rigid laths approximately equals three times the lath thickness, while the spacing between two flexibly supported laths amounts to more than five times the lath thickness, each time measured in the direction of screen travel.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawing, wherein an embodiment of the invention is shown that schematically illustrates a section of a double screen former.

The exemplification set out herein illustrates a preferred embodiment of the invention, in one form thereof, and such exemplification is not to be construed as limiting the scope of the invention in any manner.

DESCRIPTION OF THE PREFERRED EMBODIMENT

In the drawing, two travelling screens 11 and 12 (with partially still liquid fiber material suspension contained in between) pass through between a lower dewatering box 17 and an upper dewatering box 18. Contained in the lower dewatering box are a number of laths 27 (preferably with approximately rectangular cross section) which are flexibly pushed on the bottom screen 11 from below at a selective force. For that purpose they are supported, e.g., through springs 24 (or through pneumatic pressure cushions 14*a* or the like) on a rigid, water-permeable plate 26. Alternatively, the laths 27 rest on a flexible plate which si supported by several pneumatic pressure cushions. It is understood that the force of the springs (or of the pressure prevailing in the pressure cushions) is adjustable for each individual lath.

The upper dewatering box 18 can be suspended from vertically movable support elements both on the front end and the rear end, as illustrated schematically by double arrows. The dewatering box is thus adjustable but rigidly mounted after adjustment. Contained on the underside are a number of laths 28, for instance at least eight, with a preferably parallelogram-shaped cross section which bear on the topside of the upper screen 12 and are fixedly connected with the box 18. A front vacuum chamber 21 and a rear vacuum chamber 22 are provided above the laths 28, in the dewatering box 18. Before the dewatering box 18, the upper screen 12 runs across a screen guide roll 14. Thus, the drawing presumes that the bottom screen 11 forms an essentially horizontal pre-dewatering section between a not illustrated headbox and the concurrence with the upper screen (on the screen guide roll 14). In variation thereof, however, the double screen zone may begin directly at the headbox; in this case, the two screens form a wedge-shaped inlet gap directly at the headbox, with the aid or two opposite breast rolls. IN this case, an approximately vertical travel of the screens is possible as well.

It is important that in the area of the, e.g., upper dewatering box 18 the number of rigid laths 28 be larger (preferably about twice as large) than the number of the lower, flexibly supported laths 27. The spacing between two adjacent laths 28 on the upper dewatering box amounts to approximately two, three or four times the lath thickness, preferably three times. These spaces are considerably greater on the lower laths. In a preferred embodiment, the spacing between two adjacent flexibly supported laths amounts to more than five times the thickness of said flexibly supported laths, each time measured in the direction of travel of the screen. Each of the lower laths 27 within the length of the upper box 18 lies opposite a gap between two upper laths 28. Always two or three upper laths 28 are situated across a gap between two lower laths 27. These spaces between the lower laths 27, in variation from the illustrated embodiment, can be enlarged further yet as needed. For instance, they can be selected so large that the number of rigid laths amounts to three times the number of the lower, flexible laths in the area of the upper dewatering box.

The dewatering boxes 17 and 18 are followed, e.g., by a curved suction box 19 arranged in the bottom screen 11 or by a similar suction box 29 arranged in the upper screen 12, in the form of an extension of the box 18.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A double screen former for the manufacture of a fiber material web from a fiber material suspension, comprising:

two generally continuous screen loops forming together a double screen zone, each of said loops being formed by a travelling screen; wherein the travelling screen of one screen loop runs in said double screen zone across a plurality of rigid laths, said rigid laths being mutually spaced and arranged on a dewatering box; and wherein the travelling screen of the other screen loop runs in said double screen zone across a plurality of flexibly supported located substantially opposite said rigid laths, said flexibly supported being supported by means of flexible elements structured and arranged so that the flexibly supported laths are pushed on said screen at a selected force; said flexibly supported laths being mutually spaced at a spacing at least approximately twice as large as the spacing between said rigid laths.

2. The double screen former of claim 1, wherein said flexible elements comprise a plurality of springs.

3. The double screen former of claim 1, wherein said flexible elements comprise pneumatic pressure cushions.

4. The double screen former of claim 1, wherein at least a portion of said flexibly supported laths are always arranged opposite gaps between two of said rigid laths.

5. The double screen former of claim 1; in which the rigid laths each have a first thickness and the flexibly supported laths each have a second thickness, wherein the spacing between two adjacent rigid laths is approximately equal to three times said first thickness, while the spacing between two adjacent flexibly supported laths amounts to more than five times said second thickness, each measured in the direction of travel of said travelling screen.

6. The double screen former of claim 4, in which the rigid laths each have a first thickness and the flexibly supported laths each have a second thickness, wherein the spacing between two adjacent rigid laths is approximately equal to three times said first thickness, while the spacing between two adjacent flexibly supported laths amounts to more than five times said second thickness, each measured in the direction of travel of said travelling screen.

* * * * *

UNITED STATES PATENT AND TRADEMARK OFFICE

CERTIFICATE OF CORRECTION

PATENT NO. : 5,045,153

DATED : September 3, 1991

INVENTOR(S) : Hans-Peter Sollinger, et al.

It is certified that error appears in the above-identified patent and that said Letters Patent is hereby corrected as shown below:

Column 2, line 48, delete "14a" and substitute therefor --24a--;

Column 2, line 50, delete "si" and substitute therefor --is--;

Claim 1, column 4, line 12, after "supported" insert --laths--;

line 14, after "supported" (first occurrence) insert laths--.

Signed and Sealed this

Twenty-sixth Day of January, 1993

*Attest:*

STEPHEN G. KUNIN

*Attesting Officer*

*Acting Commissioner of Patents and Trademarks*